US007654491B2

(12) United States Patent
Steinmann

(10) Patent No.: US 7,654,491 B2
(45) Date of Patent: Feb. 2, 2010

(54) LOCKING DEVICE FOR SWITCH BLADES WITH ADAPTABLE PROFILES

(75) Inventor: Markus Steinmann, Zürich (CH)

(73) Assignee: Siemens Schweiz AG, Zurich (CH)

( * ) Notice: Subject to any disclaimer, the term of this patent is extended or adjusted under 35 U.S.C. 154(b) by 371 days.

(21) Appl. No.: 10/560,174

(22) PCT Filed: May 27, 2004

(86) PCT No.: PCT/EP2004/005692

§ 371 (c)(1),
(2), (4) Date: Jul. 26, 2006

(87) PCT Pub. No.: WO2004/110844

PCT Pub. Date: Dec. 23, 2004

(65) Prior Publication Data

US 2007/0272803 A1 Nov. 29, 2007

(30) Foreign Application Priority Data

Jun. 17, 2003 (EP) ..... 03013698

(51) Int. Cl.
*E01B 7/00* (2006.01)

(52) U.S. Cl. ..... 246/415 R

(58) Field of Classification Search ..... 246/415 R, 246/416, 430, 448, 449, 450
See application file for complete search history.

(56) References Cited

U.S. PATENT DOCUMENTS 1,599,047 A 9/1926 Hall
5,195,703 A * 3/1993 Kais et al. ..... 246/443
5,562,267 A 10/1996 Heim et al.
5,620,156 A * 4/1997 Berggren et al. ..... 246/221
6,354,541 B1 * 3/2002 Achleitner et al. ..... 246/448
6,616,105 B2 * 9/2003 Grunwald et al. ..... 246/430

FOREIGN PATENT DOCUMENTS

EP 0 624 508 A 11/1994
EP 0 885 795 B1 12/1998

* cited by examiner

*Primary Examiner*—S. Joseph Morano
*Assistant Examiner*—Robert J McCarry, Jr.
(74) *Attorney, Agent, or Firm*—Laurence A. Greenberg; Werner H. Stemer; Ralph E. Locher

(57) ABSTRACT

The invention is a device for displacing a switch blade between a position on a stock rail and a position at a distance from the stock rail. The device has: a locking bearing coupled to the switch blade and connected to a locking catch via an axle; and a locking rod that guides the locking catch against a locking support coupled to the stock rail, locks the locking catch to the support, and then unlocks and guides it away from the locking support. The locking support is positioned on the side of the stock rail opposed to the switch blade and is connected to a thrust bearing that is arranged on a fixed superstructure component. The locking bearing is arranged on a component that at least partially follows the displacement, and the displacement motion is transferred from the locking bearing to the switch blade via a displaceable push rod.

12 Claims, 2 Drawing Sheets

LOCKING DEVICE FOR SWITCH BLADES WITH ADAPTABLE PROFILES

BACKGROUND OF THE INVENTION

The present invention relates to a device for displacing a switch blade between a position on a stock rail and a position at a distance from the stock rail.

Railroad switches are fitted with locking devices for the purpose of securing switch blades, as disclosed for instance in European patent application EP 0 885 795 A1. This European patent application discloses the function of a modern locking device (latching closure CKA). Said document discloses not only the locking and unlocking but also the displacement of the switch blades, which in the case of a latching closure take place with the aid of a locking rod and a locking catch. The switch blade connected to the locking catch via a locking bearing is brought into contact with the associated stock rail during the locking procedure of the locking rod, during which the locking catch is guided under the stock rail and pressed upward against the foot of the stock rail, that is, against the locking support arranged at the foot of the stock rail, by the locking rod for locking the switch blade.

Particularly in the case of switch blades which are quite long, as they need to be for the larger radiuses, undesirable oscillations occur during use. These switch blades are furthermore at increased risk of torsion, as a result of which the switch blade can lift clear of the stock rail. It is known that document EP 0 624 508 A1 discloses a locking device which seeks to achieve a tight connection between the switch blade and the stock rail. This is achieved by providing the locking bearing connected to the switch blade with an elongation which presses against a locking support firmly connected to the stock rail when the locking device locks, as a result of which the switch blade pivots about the locking bearing and is pressed tightly against the stock rail.

Moreover German patent application DE 43 15 200 A1 discloses a locking device according to the document EP 0 624 508 A1 mentioned above. Said device is integrated into a hollow-section cross-tie, enabling automatic tamping of the track ballast in the region of the switch displacement device, that is, especially in the region of the tips of the switch blades.

It is common to all the above-mentioned reference documents that the locking support at the foot of the stock rail is held by gripping the foot of the stock rail on both sides and/or the locking catch is held in the locking bearing which is directly fastened to the switch blade. It is therefore easy to understand that, particularly in countries such as the USA, the UK and Japan, which have a great plurality of track and switch blade profiles, a correspondingly large number of different locking supports and/or locking bearings needs to be held in inventory and used in line with demand. It is thus expensive and time-consuming to store and use such items in this way in view of the plurality of profiles which exist. Even with only slight differences between one profile and another there is a risk that the construction team, which as a rule installs switches when the line is open to traffic, and is therefore always working under a certain amount of time pressure, might get the profiles mixed up. Such mistakes however can lead to premature wear or even to a serious malfunction.

SUMMARY OF THE INVENTION

The object of the invention is thus to specify a displacement and locking device for switch blades which manages with a particularly small number of parts despite the presence of a diversity of rail and switch profiles, at the same time making the work of the construction team efficient and to a large extent eliminating sources of error.

This object is achieved in a first variant of the previously mentioned displacement and locking device to which the invention relates, in that the device has the following components:

a) a locking bearing which is coupled to the switch blade and connected to a locking catch by means of an axle, and b) a locking rod that guides the locking catch against a locking support coupled to the stock rail, locks the locking catch to the support and then unlocks the same and guides it away from said locking support, c) the locking support being positioned on the side of the stock rail opposed to the switch blade, and being connected to a thrust bearing that is arranged on a fixed superstructure component.

By this means the locking support is successfully fastened to the stock rail without the need to fix fastening elements to the stock rail on the side of the stock rail facing toward the switch blade. This results in a "clear" inner profile against which the widest range of switch blade profiles can press. The fixed superstructure component, being a component which already exists in the track area and/or in the area of a switch, can therefore be utilized for -fastening the locking support and meets the requirement to leave the above-mentioned inner profile clear.

A particularly appropriate solution proposes using a component for supporting the switch blade as the fixed superstructure component. Such a component is designed to be very stable and is therefore suitable for holding the fastening of the locking support onto the inner side of the stock rail, if necessary even by tensioning the locking support. A switch blade slide chair proves to be particularly suitable for this purpose. This slide chair can also take the form of a switch blade slide bearing or a switch blade roller bearing.

As already disclosed in German patent application 43 15 200, a switch displacement device can also be integrated into a hollow-section cross-tie. In such a case it is particularly advantageous in an embodiment of the invention if the fixed superstructure component is arranged on a rising edge of a cross-tie member having a U-shaped profile.

In principle however, virtually any flange attached to a cross-tie member is suitable as a fixed superstructure component. This flange merely needs to be stable enough to act as a thrust bearing for the locking support fastening. The flange can obviously therefore be strengthened with the aid of supporting bridge pieces or the like.

A particularly appropriate fastening for the locking support occurs on the outer side of the stock rail (the side of the stock rail facing away from the switch blades) if the locking support is tightly coupled in the foot area of the stock rail. The locking support can then enclose the foot of the rail like a clamp on the outer side and thus be tensioned in a direction which is mainly vertical to the longitudinal extent of the stock rail.

The object mentioned above is further achieved in a second variant of the previously mentioned displacement and locking device to which the invention relates, in that the device has the following components:

a) a locking bearing which is coupled to the switch blade and connected to a locking catch by means of an axle, and b) a locking rod that guides the locking catch against a locking support coupled to the stock rail, locks the locking catch to the support and then unlocks the same and guides it away from said locking support, c) the locking bearing being arranged on a component that at least partially follows the displacement and the displacement motion being transferred from the locking bearing to the switch blade by means of a displaceable push rod.

This method avoids any direct connection between the locking bearing and the switch blade without having to give up the advantages of the locking bearing whereby the locking catch is supported so that it can rotate about an axle that is mainly parallel to the longitudinal extent of the stock rail. The push rod deals with the adaptation to different switch blade profiles, and is accordingly designed to be displaceable. A locking component that follows the displacement of the locking rod is for example the locking rod itself, the push rod or a component which is itself an element in the system linking the push rod to the locking rod. Such a component can also be an additional supporting element or slide member or the like which is fastened to one or more of the above-mentioned components and therefore supports the locking bearing.

A preferred variant in an embodiment of the invention proposes connecting the push rod firmly to the switch blade and holding it in the locking bearing so that it is movable. As a rule this variant requires a drill hole in the switch blade so that the push rod can be bolted to the switch blade. However, a solution in which the push rod has no drill hole but is held on the switch blade by clamping or tensioning or the like is also conceivable.

As an alternative the push rod can be held in the locking bearing so that it is movable and the two switch blades can be connected by means of a coupling rod. Then in the event of displacement, one switch blade is pushed as far as the stock rail by the push rod and the other switch blades are pulled away by the stock rail with the aid of the coupling rod in each case. In this case also, virtually any number of different switch blade profiles can be accommodated thanks to the mobility of the push rod in the locking bearing.

In a further embodiment of the invention the push rod can be held in the locking bearing and prevented from moving by means of a defined tractive power. Thus the switch blades can be forced open in a way that is non-destructive for the switch displacement mechanism, the alternative solution having been for example to install components in which the desired breaking points are predefined. According to this variant, instead of broken components having to be replaced when the switch blades have been forced open, the push rod need only be moved back to its original position and once more fastened with the predefined tractive power. In this case said tractive power can be provided by a spring-loaded catch. Embodiments are therefore conceivable in which a sphere or a cylinder is pressed into a bulge in the push rod by means of a spring. Thanks to this bulge it is also possible to return the push rod to the correct position (after the switch blades have been forced open) without any special adjustment tools or the like, because the best and thus the correct final position of the push rod can be found almost automatically due to the force of the spring.

Lastly the object mentioned above is achieved in yet a third variant according to the invention. This third variant is a combination of the first and second variants, and has the following features: Device for displacing a switch blade between a position on a stock rail and a position at a distance from the stock rail, having:

a) a locking bearing which is coupled to the switch blade and connected to a locking catch by means of an axle, and b) a locking rod that guides the locking catch against a locking support coupled to the stock rail, locks the locking catch to the support and then unlocks the same and guides it away from said locking support, c) the locking support being positioned on the side of the stock rail opposed to the switch blade, and being connected to a thrust bearing that is arranged on a fixed superstructure component; and d) the locking bearing being arranged on a component that at least partially follows the displacement and the displacement motion being transferred from the locking bearing to the switch blade by means of a displaceable push rod.

Further advantageous embodiments of the invention are to be found in the remaining sub-claims.

BRIEF DESCRIPTION OF THE SEVERAL VIEWS OF THE DRAWINGS

Exemplary embodiments of the invention will be explained in greater detail with the aid of the attached drawings. These show the following.

DETAILED DESCRIPTION OF THE INVENTION

Figure 3:
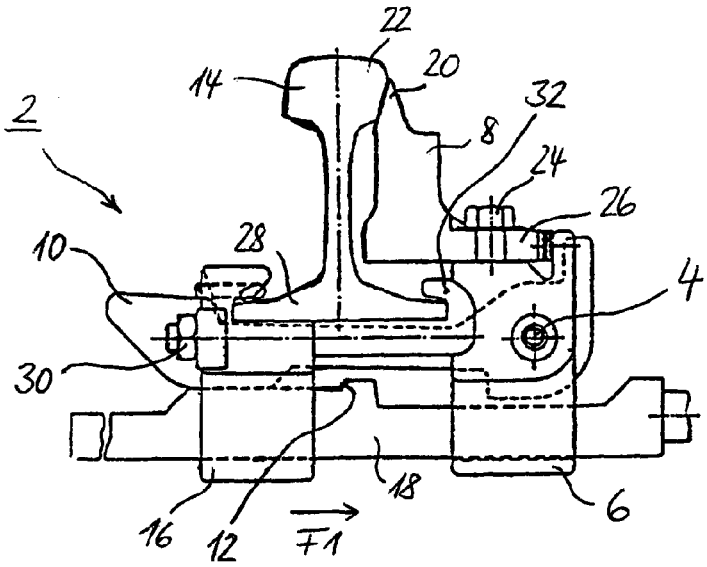
FIG. 3 PRIOR ART
FIG. 3 a locking device known from document EP 0 624 508 Al.

FIG. 3 shows a locking device 2 which is known from document EP 0 624 508 A1 and which has a locking catch 10 connected by means of an axle 4 and a locking bearing 6 to a switch blade 8; after closing, said locking catch presses tightly against a surface 12 of a locking support 16 connected to a stock rail 14 and is firmly blocked in that position by a locking rod 18. The locking bearing 6 is provided underneath with an extension (not shown in greater detail) which when the locking device is closed abuts against the locking support 16, transmitting a force F1 to the locking bearing 6 and causing a head 20 of the switch blade 8 to be pressed against the head 22 of the stock rail 14. The locking bearing 6 is connected by a bolted connection 24 to the foot 26 of the switch blade 8, said switch blade being designed in such a way that its foot 26 rests on the foot 28 of the stock rail 14 when the head 20 of the switch blade 8 is pressed against the head 22 of the stock rail 14. It is therefore easy to see that the locking bearing 6 can readily be fastened to the foot 26 of the switch blade 8. Similarly the locking support 16 can also be tensioned against the foot 28 of the stock rail 14 by means of a clamping screw 30 and a clamping hook 32.

However, this embodiment of the locking device 2 cannot be used if for example the switch blade 8 has a different profile so that there is no room available at the foot 28 of the stock rail 14 for the fastening of the clamping hook 32. This embodiment is also problematical if there is a great plurality of different profiles for the stock rails and switch blades in a rail network. In this case a separate locking bearing and a separate locking support must be used for each profile.

Figure 1:
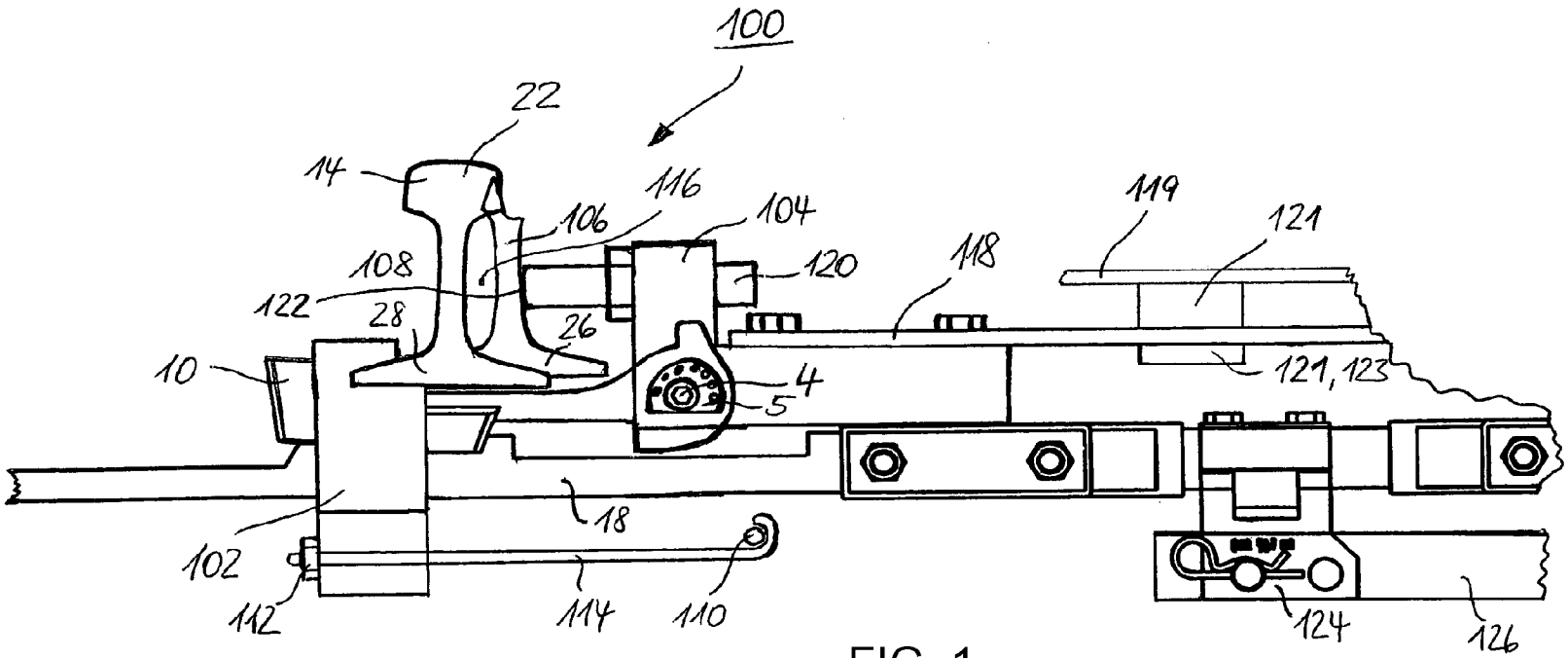
FIG. 1 a side view of a first displacement device for a switch blade.

FIG. 1 is a diagram showing a side view of a first locking device 100 according to the invention, in which support is provided for a locking support 102 and a locking bearing 104 in a way that is independent of the respective profiles of the stock rail 14 and of a switch blade 106 that has been changed in comparison with FIG. 3.

As in FIG. 3, the locking support 102 is fastened on the side 108 facing away from the switch blade 106, by virtue of its tight grip on the foot 28 of the stock rail 14. At the same time, however, a thrust bearing is created in the form of a bolt 110, so that the locking support 102 can be tensioned by means of a clamping screw 112 and a hooked rod 114. The bolt 110 is attached in a manner not shown here to a superstructure component, for instance on the inner side of a hollow-section cross-tie or on the underside of a slide bearing for the switch blade 106. For the sake of a clearer main illustration, this figure shows the bolt 110 to be arranged below the foot 26 of the switch blade 106. It is clear that when the arrangement is this low, the tensioning could give rise to outwardly directed torque which could have a generally undesirable effect on the stock rail 14. The bolt 110, or in general terms, a thrust bearing for fastening the locking support 102, is therefore as a rule arranged at a level which will avoid giving rise to outwardly directed torque (except of course in cases where such outwardly directed torque may be expressly desired).

Due to this method of support using the concept of a thrust bearing arranged on a superstructure component which as a rule already exists, enough clear space remains in the interior space 116 facing toward the switch blade 106 for switch blades 106 that are milled from the profile of the stock rail 14 also to be brought into play on the stock rail 14.

The locking bearing 104 has likewise been mounted in a way which enables completely different switch blade profiles to be used. The locking bearing 104 is hence supported with the aid of a slide plate 118 which closely engages with a superstructure component by means of a sliding fit. In the present example the superstructure component is a cover plate 119 (partially shown) which closes the space in a hollow cross-tie or a cross-tie compartment in an upward direction. Arranged on this cover plate 119 are L-shaped guides 121 having a part 123 running horizontally on which the slide plate 118 slides. By this means the displacement is transmitted from the locking rod 18 via the locking catch 10 to the locking bearing 104 fastened to the slide plate 118. When the switch blade 106 is displaced, the slide plate 118 is moved forward and back between the two end-positions of its travel. As an alternative to a sliding support for the slide plate 118 a roller bearing or the like can also be used. The slide plate 118 is thus supported on the guides 121, 123, which also act as slide bearings. The guides 121, 123 therefore bear the weight of the locking bearing 104. The locking catch 10 is supported, as mentioned, on the axle 4 in the locking bearing 104. In the upper part of the locking bearing 104 a push rod 120 is supported in a drill hole in such a way that it can move. The push rod 120 is locked in each final position, enabling the front end 122 of the push rod 120 to press accurately against the switch blade 106. When the switch is displaced the push rod 120 abuts against the switch blade 106 in the position shown in FIG. 1. By means of a coupling rod (not shown) for the two switch blades 106, the push rod 120 affects the other side of the locking device 100 opposite the split pin 124 in the axially symmetrical drive rod 126, so that the opposite switch blade abuts against the opposite stock rail and the switch blade 106 shown in FIG. 1 is then guided away from the stock rail 14. The previously mentioned coupling rod between the two switch blades 106, also known as a tie rod, can also be achieved by means of a continuous slide plate 118 which either itself has elements coupled to the switch blades 106 or is part of an arrangement in which the push rods 120 are able not only to push a switch blade into a desired position but also to pull a switch blade into a desired position. It can then be an advantage, particularly in the last mentioned case, to design the slide plate 118 separately for each locking bearing 104. This results in the ability to force open the switch without the slide plate 118 being damaged, as would be the case with a continuous slide plate 118, because when the switch is forced the second of the two switch blades 106 is forced into a position away from the stock rail 14 in each case.

Figure 2:
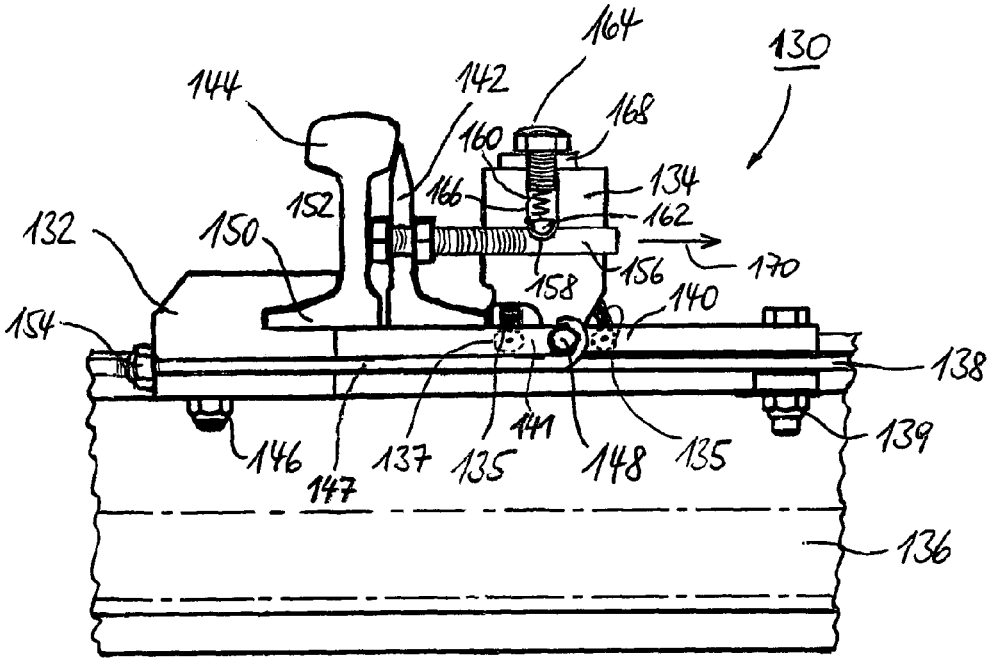
FIG. 2 a side view of a second displacement device for a switch blade.

FIG. 2 is a diagram showing a side view of a second locking device 130. For the most part only the mountings for a locking support 132 and for a locking bearing 134 are shown for the sake of clarity. The whole locking device 130 is integrated in a hollow-section cross-tie 136, open in the upward direction, having a U-shaped profile and outward facing flanges 138. Mounted on these flanges 138 and secured by means of bolted connections 139 is a slide chair 140 for a switch blade 142. A stock rail 144, modified in profile compared to the previously described stock rails 14, is also fastened on the flanges 138 by means of bolted connections 146.

A bolt 148 which projects sideways is provided on the inward facing sides of the slide chairs 140 in each case, and acts as a thrust bearing for the fastening of the locking support 132. Due to the way it is mounted, the locking support encloses the foot 150 of the stock rail 144 on its outer side 152 and is fastened by means of a clamping screw 154, which tensions a hooked rod 156 gripping the bolt 148. This fastening is provided on both the slide chairs 140 fastened on the flanges 138. In view of the profiles of stock rail 144 and switch blades 142 present at this point it is easy to understand that at the foot 150 of the stock rail 144 no room would be available on its inner side for the fastening of the locking support 132. The fastening of the locking support 132 can however be achieved in a way previously described without a drill hole in the stock rail, as is often required by rail infrastructure operators.

The locking bearing 134 is also fastened in a correspondingly flexible manner. The locking bearing 134 is fastened to a slide member 135 which itself rolls (idlers 137 indicated by broken lines) in a guideway 141 arranged on the inward facing lateral surfaces of the slide chairs 140. In the locking bearing 134, the locking catch (not shown) is supported as before so that it can rotate about the axle 4 and is held in an eccentric bush 5 (cf. FIG. 1). Moreover the locking bearing 134 has a mainly horizontal drill hole in which a push rod 156 is held in such a way that it can move. The push rod 156 can be connected firmly to the switch blade 142 by means of a threaded connector arranged on said push rod 156.

Additionally the push rod 156 has a cylindrical recess 158 into which a roll body 162 is pressed by a spring 160. The spring 160 is tensioned by means of a bolt 164 which is screwed into a vertical spring casing 166. A predefined tractive power can be exerted on the push rod 156 by selecting a particular thickness for a washer 168. The tractive power is chosen so as to enable the switch to be forced open in the direction of travel when traffic passes over it. When a wheel rim penetrates the locked switch blade 142 a force is exerted on the switch blade 142 in the direction of an arrow 170. When the tractive power exerted by the spring 160 is overcome, the push rod 156 is moved in the direction 170. It is true that an adjustment to the push rod 156 has become necessary as a result, but total destruction of the displacement device due to the forcing can be reliably avoided in this way.

The second locking device 130 therefore also shows the desired advantages of easy adaptability to different profiles of the stock rail 144 and of the switch blades 142, as was also demonstrated with the first locking device 100.

KEY TO REFERENCE CHARACTERS

2 Known locking device
4 Axle
5 Eccentric bush
6 Locking bearing

8 Switch blade
10 Locking catch
12 Surface
14 Stock rail
16 Locking support
18 Locking rod
20 Head of the switch blade 8
22 Head of the stock rail 14
24 Bolted connection
26 Foot of the switch blade 8
28 Foot of the stock rail 14
30 Clamping screw
32 Clamping hook
F1 Force
100 First locking device according to the invention
102 Locking support
104 Locking bearing
106 Switch blade
108 Side facing away from the switch blade 106
110 Bolt
112 Clamping screw
114 Hooked rod
116 Interior space
118 Slide plate
119 Cover plate
120 Push rod
121 L-shaped guide
122 Front end of the push rod 120
123 Horizontal part of the L-shaped guide 121
124 Split pin
126 Drive rod
130 Second displacement device according to the invention
132 Locking support
134 Locking bearing
135 Slide member
136 Hollow-section cross-tie
137 Idlers
138 Flanges
139 Bolted connection
140 Slide chair
141 Guideway
142 Switch blade
144 Stock rail
146 Bolted connection
147 Hooked rod
148 Bolt
150 Foot of the stock rail 144
152 Side facing away from the switch blade 142
154 Clamping screw
156 Push rod
158 Cylindrical recess
160 Spring
162 Roll body
164 Bolt
166 Spring casing
168 Washer
170 Arrow

The invention claimed is:

1. A device for displacing a switch blade between a position adjacent a stock rail and a position at a distance from the stock rail, the device comprising:

a) a locking bearing coupled to the switch blade and connected to a locking catch by means of an axle;

b) a locking rod arranged to guide the locking catch against a locking support coupled to the stock rail, the locking rod further arranged to lock the locking catch to the support and then unlock the locking catch and guide it away from the locking support;

c) the locking support being tightly fitted to a foot of the stock rail on the side of the stock rail opposed to the switch blade for fastening to the stock rail, the locking support additionally being connected to a thrust bearing that is arranged on a fixed superstructure component including at least one of a switch blade slide chair and a rising edge of a cross-tie member having a u-shaped profile on a side of the stock rail facing the switch blade.

2. The device according to claim 1, wherein the fixed superstructure component is a component for supporting the switch blade.

3. The device according to claim 2, wherein the component for supporting the switch blade is a switch blade slide chair.

4. The device according to claim 1, wherein the fixed superstructure component is arranged on a rising edge of a cross-tie member having a U-shaped profile.

5. A device for displacing a switch blade between a position adjacent a stock rail and a position at a distance from the stock rail, the device comprising:

a) a locking bearing coupled to the switch blade and connected to a locking catch by means of an axle;

b) a locking rod arranged to guide the locking catch against a locking support coupled to the stock rail, lock the locking catch to the support and then unlock and guide it away from said locking support;

c) the locking support being tightly fitted to a foot of the stock rail on the side of the stock rail opposed to the switch blade for fastening to the stock rail, the locking support additionally being connected to a thrust bearing that is arranged on a fixed superstructure component including at least one of a switch blade slide chair and a rising edge of a cross-tie member having a u-shaped profile on a side of the stock rail facing the switch blade; and d) the locking bearing being arranged on a component that at least partially follows the displacement and the displacement motion is transferred from the locking bearing to the switch blade by means of a displaceable push rod.

6. The device according to claim 5, wherein the push rod is firmly connected to the switch blade and held in the locking bearing such that it can move.

7. The device according to claim 6, wherein the push rod is held in the locking bearing so that it is movable and the two switch blades can be connected by means of a coupling rod.

8. The device according to claim 5, wherein, the push rod is held in the locking bearing and prevented from moving by a defined tractive power.

9. The device according to claim 8, wherein the tractive power is achieved by means of a spring-loaded catch.

10. The device according to claim 5, wherein, the component is supported in a rolling or sliding mode.

11. The device according to claim 10, wherein the support for the component is provided in or on a guide element.

12. The device according to claim 11, wherein the guide element is arranged on a superstructure component.

* * * * *